US006753789B1

(12) United States Patent
Batra et al.

(10) Patent No.: US 6,753,789 B1
(45) Date of Patent: Jun. 22, 2004

(54) REMOTE CONTROL PANEL

(75) Inventors: Sanjay Batra, Chicago, IL (US); Anton Poole, Dakota Dunes, SD (US)

(73) Assignee: Gateway, Inc., Poway, CA (US)

( * ) Notice: Subject to any disclaimer, the term of this patent is extended or adjusted under 35 U.S.C. 154(b) by 0 days.

(21) Appl. No.: 09/168,599

(22) Filed: Oct. 8, 1998

(51) Int. Cl.[7] ..... G08C 19/00

(52) U.S. Cl. ..... 340/825.69; 340/825.72; 340/825.56; 341/176; 455/90

(58) Field of Search ..... 340/825.69, 825.72, 340/825.56, 539; 361/814; 455/128, 90; 341/176; 312/305

(56) References Cited

U.S. PATENT DOCUMENTS

| | | | | |
|---|---|---|---|---|
| 4,602,828 A | | 7/1986 | Omata | 312/319 |
| 4,712,693 A | * | 12/1987 | Striplin | 211/164 |
| 4,733,776 A | * | 3/1988 | Ward | 206/305 |
| 4,768,230 A | | 8/1988 | Viebrantz et al. | 455/603 |
| 4,809,360 A | | 2/1989 | Kraft | 455/603 |
| 4,878,055 A | * | 10/1989 | Kasahara | 341/23 |
| 5,073,979 A | | 12/1991 | Webb | 359/142 |
| 5,181,024 A | | 1/1993 | Tsunoda et al. | 340/825 |
| 5,376,934 A | * | 12/1994 | Savazzi | 341/22 |
| 5,471,254 A | * | 11/1995 | Claassen | 348/734 |
| 5,732,135 A | * | 3/1998 | Weadon et al. | 379/433 |
| 5,943,625 A | * | 8/1999 | Yeom et al. | 455/557 |
| 6,011,460 A | * | 1/2000 | Flick | 340/426 |

* cited by examiner

*Primary Examiner*—Michael Horabik
*Assistant Examiner*—M Shimizu
(74) *Attorney, Agent, or Firm*—Scott Charles Richardson; Bradley A. Forrest; Schwegman - Lundberg Woessner - Kluth

(57) ABSTRACT

A remote control device is provided with a rotatably mounted door member. The device has a main body with two, three, or more sides adapted for having selection buttons coupled therewith. The door member covers the selection buttons for the sides not in use so that the user can grasp the device or set the device on a surface without inadvertent actuation of the selection buttons. The remote control device also has a locking mechanism for preventing access to certain selection buttons on certain side surfaces.

34 Claims, 4 Drawing Sheets

REMOTE CONTROL PANEL

FIELD OF THE INVENTION

The present invention relates generally to devices for remote control of electronic devices. More particularly, it pertains to panels for remote control devices.

BACKGROUND OF THE INVENTION

Remote control devices are used extensively in consumer products for remotely controlling a wide variety of electronic devices. The different types of devices which use remote controls has also increased. Some of the devices which currently use remote controls include television, video cassette recorder (VCR), receiver, disc player, tape player, video conferencing equipment, DVD, and cam corders. The use of remote control devices has also increased, in part, due to on-screen menus which allow for selection of features with a remote control.

Complexity of the electronic devices has led to more complex remote controls requiring several selection buttons. As a result, the surface area for the remote control devices has become larger and larger. This is undesirable since a larger remote control is difficult to hold and control with one hand. Physically challenged individuals would find holding these larger remote controls even more difficult.

In addition, remote control devices also are used for devices for which limited access is desirable. For instance, some movies or television shows may be inappropriate for children to view, and parents may wish to limit access. While some satellite dish companies allow for parental control through programming, not all systems, including network television, have these features.

A conventional remote control device is shown in FIGS. 1A and 1B. A remote control 100 has a sliding panel 110 attached therewith. To access buttons 120 below the panel 110, the panel 110 slides away from the remote control 100 to the position shown in FIG. 1B. Although the panel 110 prevents inadvertent actuation of the buttons 120, the panel 110 can be easily broken off.

Accordingly, what is needed is a remote control device capable of additional selection abilities without requiring a larger remote. What is further needed is a remote control device which allows for control over selection.

SUMMARY OF THE INVENTION

A device for remotely controlling electronic equipment has a main body having a plurality of surfaces, including at least a first surface and a second surface. In one embodiment, each surface has at least one selection button coupled therewith. A cover is rotatably coupled with the main body. The cover is rotatable around the main body from a first position to a second position to restrict access to selected surfaces having selection buttons.

The remote control device has selection buttons which are coupled with the first and/or second surfaces of the main body, depending on the particular configuration. In yet another embodiment, the device has a locking mechanism for preventing access to a particular side and/or particular selection buttons. The locking mechanism alternatively prevents the cover member from inadvertently rotating around the main body. The locking mechanism can have a number of configurations, including but not limited to, a projection and detent combination, a child proof cap, or a key-lock mechanism.

The remote control device has many advantages over conventional remotes. For example, the provided remote device allows for increased surface area with which additional selection buttons can be coupled. The additional surface area allows for fewer selection buttons to be coupled on each side surface. The fewer selection buttons per surface assists in reducing the cognitive complexity of the remote by reducing the number of buttons for a user to select from a single surface. Using the multiple sides of the device for different devices allow for the elimination of duplicate remote controls. The main body and cover member can be rounded or cylindrically shaped, which is comfortable for a user's hand. A further advantage provided is that since the cover member rotates about the main body, the cover member is not placed in a position where it could easily be broken off. The door protects the selection buttons from being inadvertently actuated when the remote is set on a surface, such as a table or the floor. In addition, the door protects the selection buttons from being inadvertently actuated when the remote device is grasped by a user. A further benefit is the locking feature which prevents access to certain features and/or selection buttons of the remote device. Parents can better supervise what functions or television shows to which their children or others access.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims.

Figure 1A:
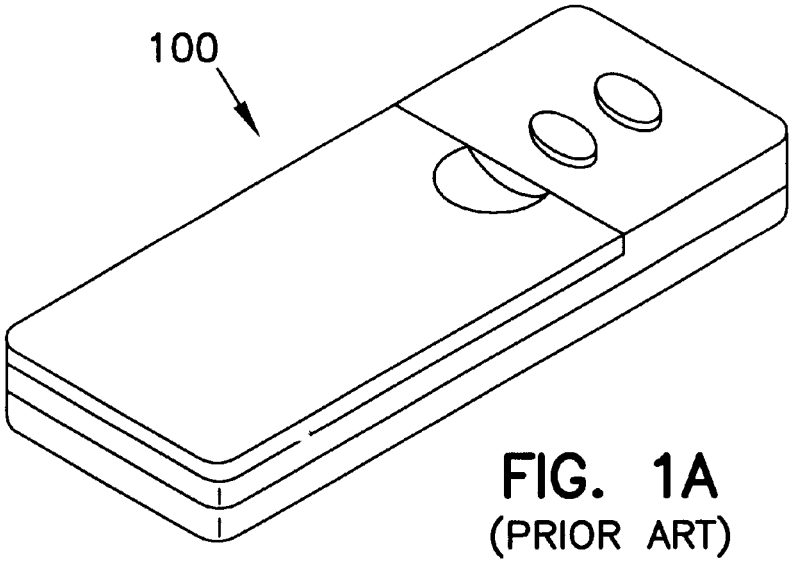
FIG. 1A (PRIOR ART)
FIG. 1A is a perspective view illustrating a prior art remote control.
Figure 1B:
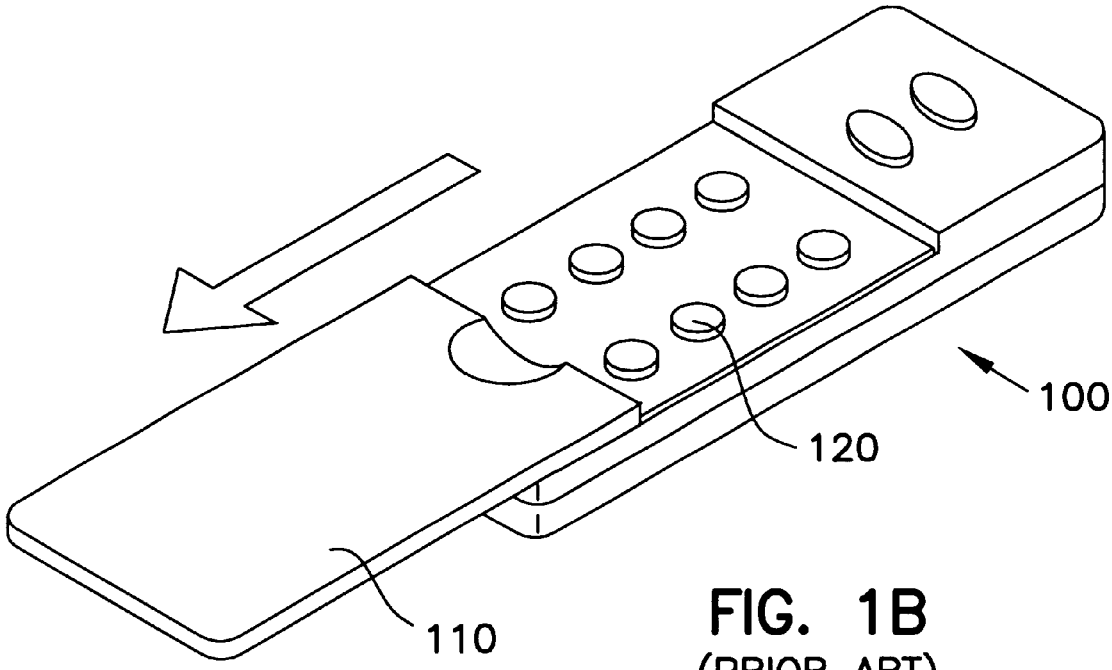
FIG. 1B (PRIOR ART)
FIG. 1B is a perspective view illustrating the prior art remote control shown in FIG. 1A.
Figure 2:
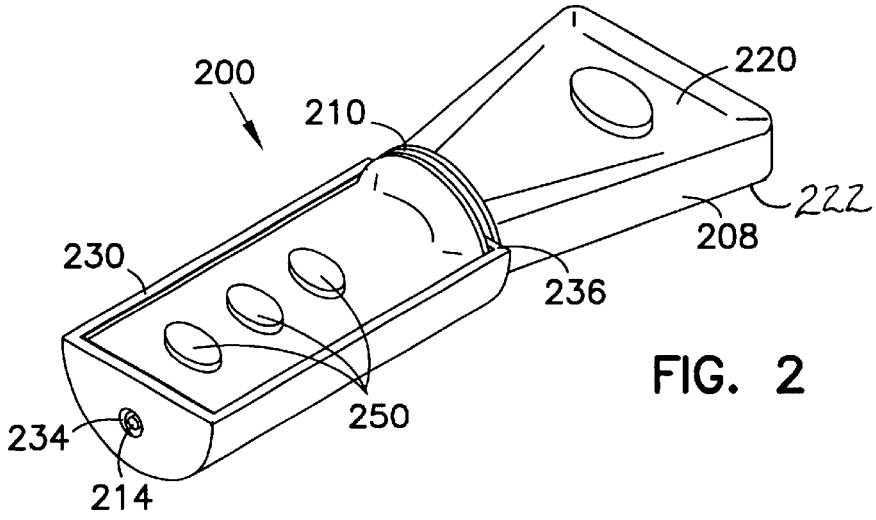
FIG. 2 is a perspective view illustrating a remote control device constructed in accordance with one embodiment of the present invention.
Figure 3:
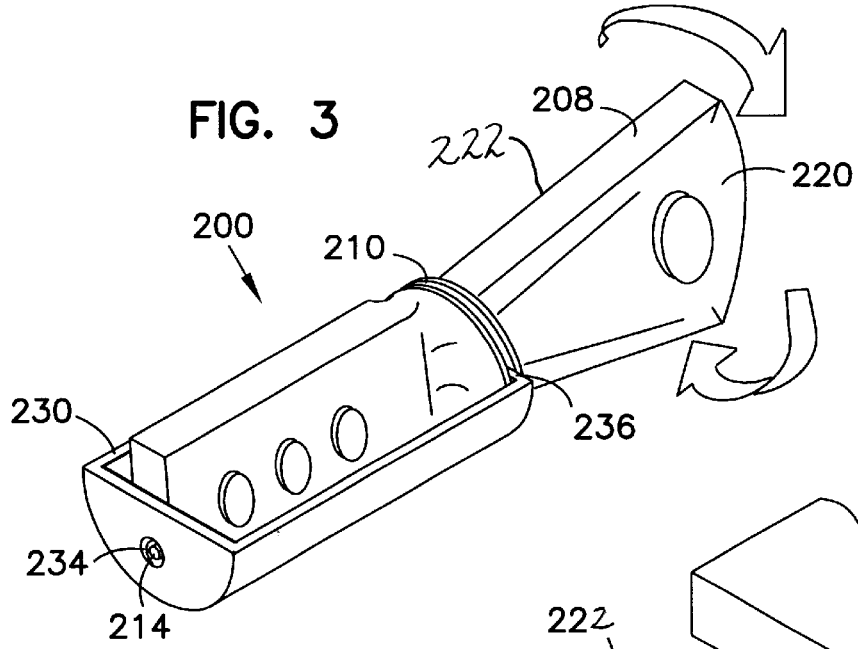
FIG. 3 is a perspective view illustrating a remote control device constructed in accordance with one embodiment of the present invention.
Figure 4:
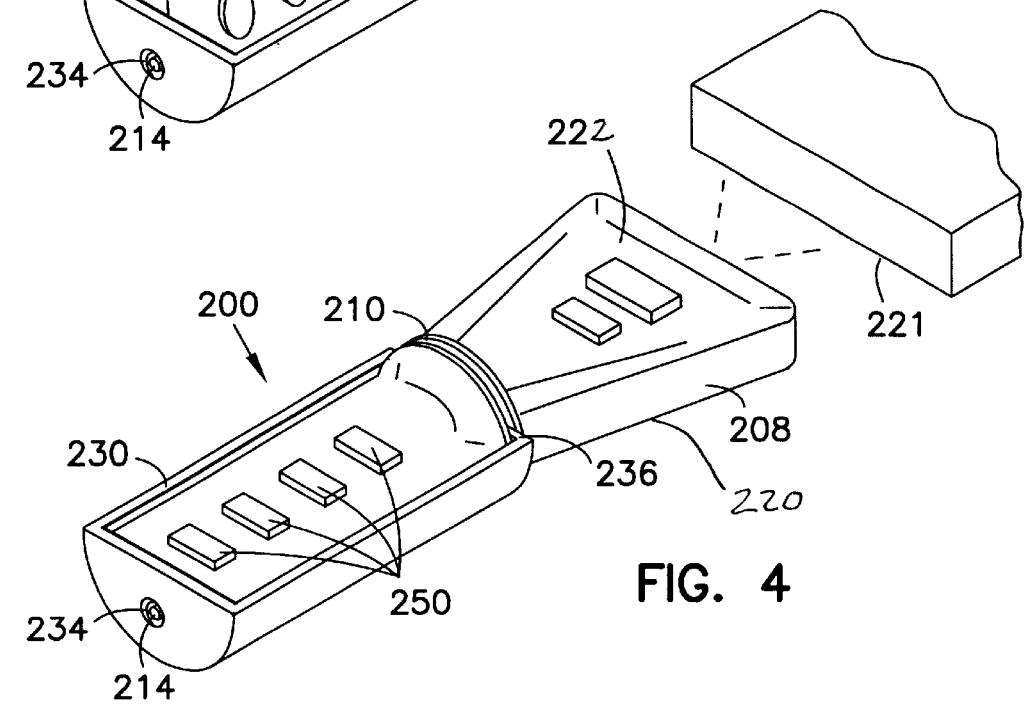
FIG. 4 is a perspective view illustrating a remote control device constructed in accordance with one embodiment of the present invention.

A first embodiment of a device 200 for remotely controlling an electronic device is shown in FIGS. 2–4. The device 200 comprises a main body 208 and a cover member 230. The main body 208, in one embodiment, has a generally cylindrical shape. Alternatively, other shapes could also be incorporated, or the main body 208 could also have a non-uniform shape. The main body is defined in part by a first side surface 220 and a second side surface 222. In one embodiment, the first side surface 220 is opposite the second side surface 222 such that surfaces 220 and 222 are parallel to one another.

The main body 208 has at least one selection button 250 coupled with the first side surface 220. The selection button 250 can be coupled with the first side surface 220 in a wide variety of manners. For instance, the selection button 250 can be disposed through the surface 220 as is in conventional remote control devices. Alternatively, the selection button 250 could form a part of the surface 220, where the selection button 250 seals the inside of the device 200 away from the environment. The selection button 250, in another embodiment, is disposed both on first side surface 220 and the second side surface 222. In one embodiment, the main body 208 also has an annular groove 210 therein. The groove 210 allows the cover member 230 to rotate about the main body 208, as will be described further below. In another embodiment, the main body 208 also has a pin 214 for coupling with the cover member 230.

The cover member 230 forms a cover for the selection button 250, and assists in preventing the selection button 250 from being inadvertently actuated by a user. The cover member 230 covers at least the first side surface 220. In one embodiment, the cover member 230 covers more than one surface of the main body 208 at the same time. In another embodiment, the cover member 230 has a generally hemispherical shape. The hemispherical shape allows for the main body to freely rotate within the cover member 230. The hemispherical shape also creates a rounded cover member 230 which fits comfortably within the hand of a user.

In another configuration, the cover member 230 has a projection 236. The projection 236 is received by the groove 210 of the main body 208. In addition, the cover member 230 has an aperture 214, where the aperture 214 receives the pin 214 of the main body 208. The groove 210 and projection 236 combination allow the main body 208 to rotate within the cover member 230 and also allows the cover member 230 to be attached with the main body 208. The pin 214 and the apertures 234 also assist in accommodating the main body 208 rotation and coupling the cover member 230 with the main body 208. Alternatively, in another configuration, a spring is disposed between the main body 208 and the cover member 230, thereby causing a frictional fit.

During use, the main body 208 is positioned where the first side surface 220 is positioned upward. The user then can actuate each of the selection buttons 250. If a user wishes to access the second side surface 222 of the main body 208, the main body 208 is rotated relative to the cover member 230, as shown in FIGS. 3 and 4. The main body 208 is rotated relative to the cover member 230 until the second side surface 222 is not covered by the cover member 230, as shown in FIG. 4. Now, the user can access the selection buttons 250 on the second side surface 222.

FIG. 4 illustrates another embodiment of the device 200, where the device 300 is adapted to remotely control a host device 221. The host device 221 can comprise a number of electronic components, such as, television, video cassette recorder (VCR), receiver, disc player, tape player, video conferencing equipment, DVD, cam corders, and computers, although other components can also be incorporated. The host device 221 is adapted to receive signals sent from the device 200, as the user presses selection buttons 250.

Figure 5:
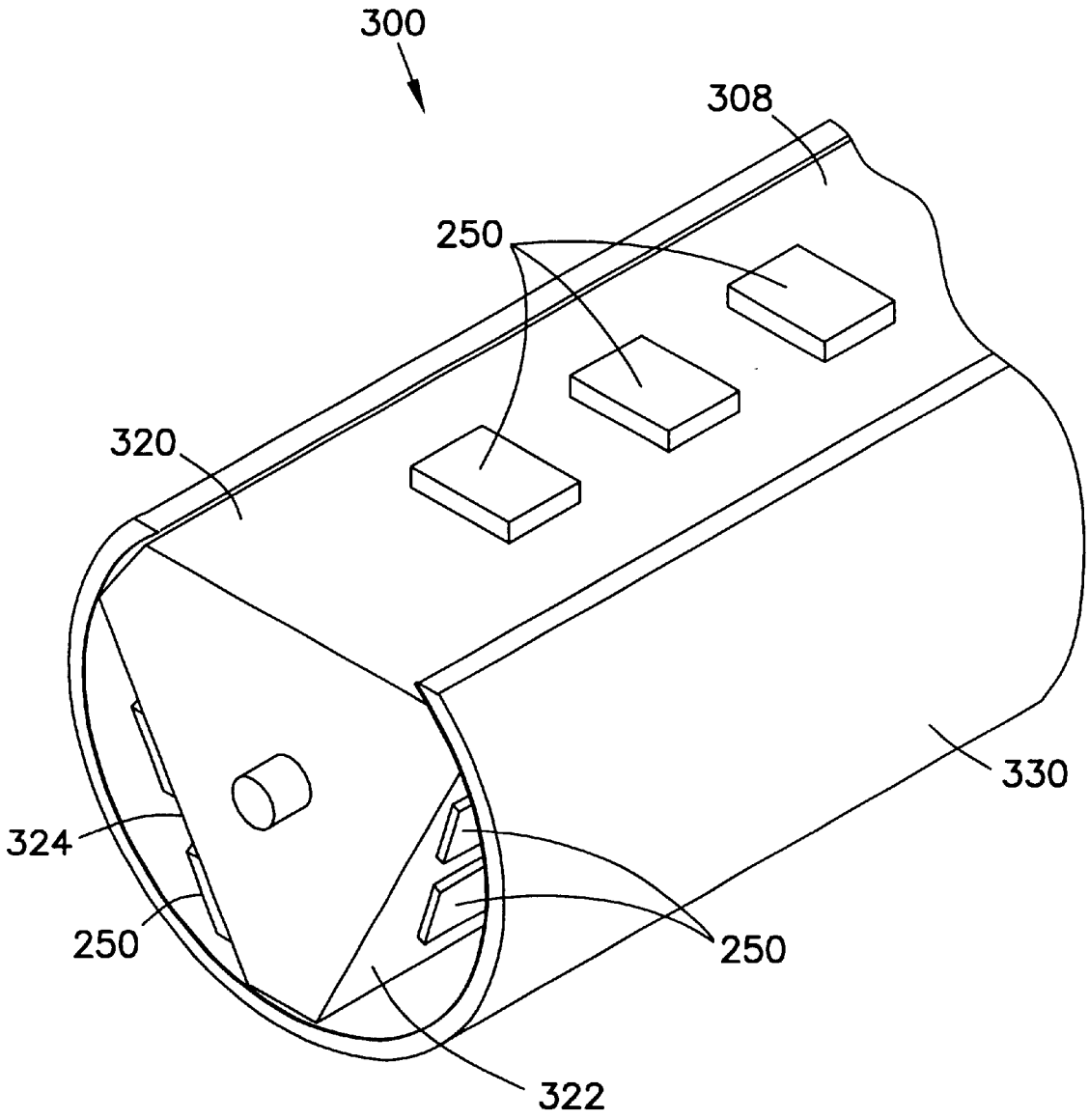
FIG. 5 is a perspective view illustrating a remote control device constructed in accordance with one embodiment of the present invention.

FIGS. 5 illustrates another embodiment of a device 300 for remotely controlling electronic devices. The device 300 has a main body 308 and a cover member 330, where the cover member 330 rotates about the main body 308 as discussed above. In this configuration, the main body 308 has a first side surface 320, a second side surface 322, and a third side surface 324. Alternatively, the body 308 could also have additional side surfaces, and is considered within the scope of the invention. The cover member 330, in one embodiment, covers at least two of the side surfaces when one of the side surfaces is exposed, as shown in FIG. 5. In another configuration, the cover member 300 covers each side surfaces sequentially. Coupled with the side surfaces 320, 322, 324 are selection buttons 250. The selection buttons 250 are disposed on at least one side surface, and can be disposed on each of the first side surface, second side surface 322, and third side surface 324.

Figure 6:
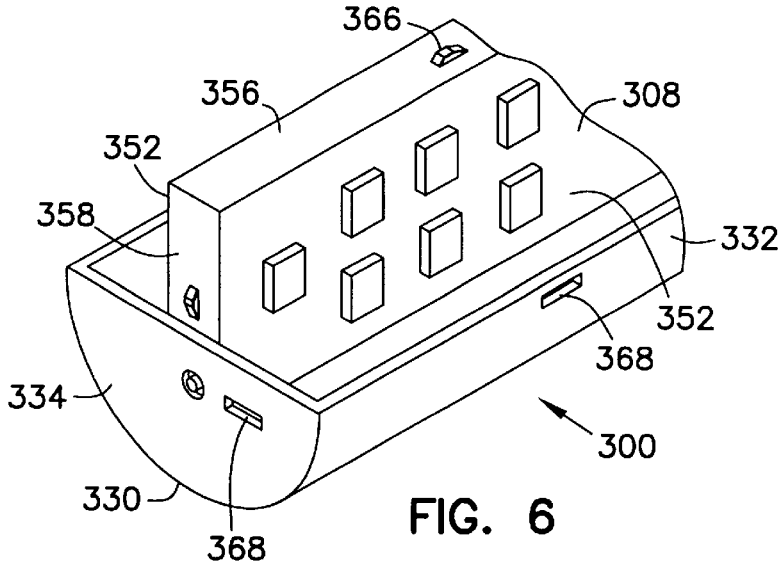
FIG. 6 is a perspective view illustrating a remote control device constructed in accordance with one embodiment of the present invention.

FIG. 6 illustrates another embodiment of the remote control device. The device 300 has a main body 308 and a cover member 330, where the cover member 330 rotates about the main body 308 as discussed above. In this configuration, the cover member 330 has a side portion 332 and an end portion 334. The main body 308 has a first side surface 352, a second side surface 354, a side surface 356, and an end surface 358. Alternatively, the body 308 could also have additional side surfaces, and is considered within the scope of the invention. Coupled with the side surfaces 352 and 354 are selection buttons 250.

The side surface 356 and the end surface 358 each have a detent 366 therein. The side portion 332 and the end portion 334 of the cover member 330 each have a projection 368. The projection 368 is for mating with the detent 366, and forms a locking mechanism. Other combinations other than the projection 368 and the detent 366 could also be incorporated into the remote device 300. For instance, the projection 368 could comprise a spring bias into or toward the detent 366. When the main body 308 is rotated relative to the cover member 330, the projection 368 engages with the detent 366, thereby preventing the main body 308 from continual rotation until additional force is used to disengage the projection 368.

Figure 7:
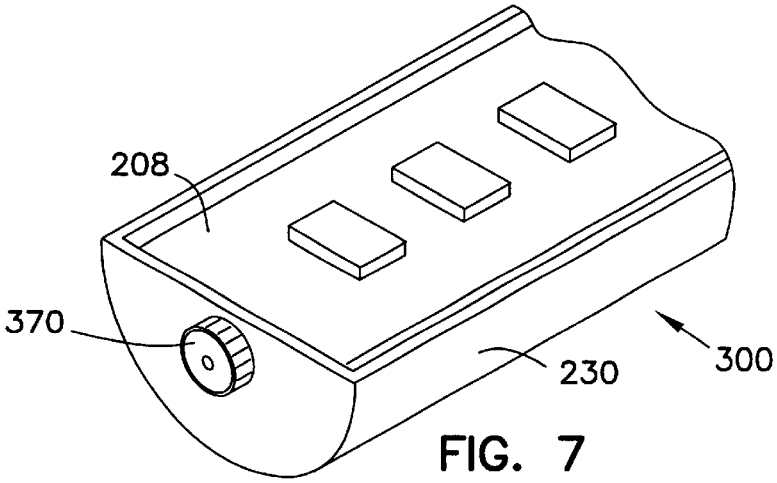
FIG. 7 is a perspective view illustrating a remote control device constructed in accordance with one embodiment of the present invention.
Figure 8:
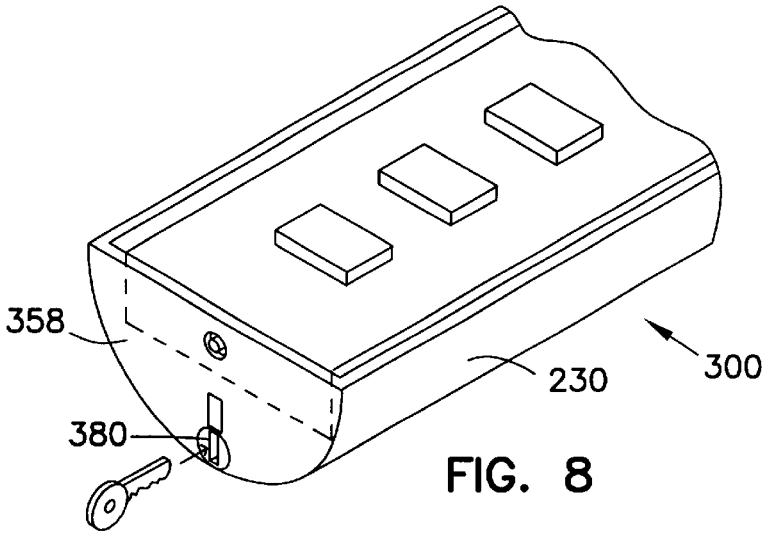
FIG. 8 is a perspective view illustrating a remote control device constructed in accordance with another embodiment of the present invention.

FIG. 7 illustrates another embodiment of the locking mechanism. The end surface 358 of the cover member 230 has a child proof cap 370. The cap 370 prevents a user from rotating the cover member 230 relative to the main body 308 and accessing selection buttons 250 on the opposite side of the main body 308 unless the cap 370 is removed. In another embodiment, as shown in FIG. 8, the end surface 358 of the cover member 230 has a key lock 380 therein. The key lock 380 prevents a user from rotating the cover member 230 relative to the main body 308 and accessing selection buttons 250 on the opposite side of the main body 308 unless a key is inserted and the key lock 380 unlocked. The locking mechanism provides the benefit of allowing parents or custodians to control access to certain equipment and/or shows by limiting access to certain selection buttons 250 on the remote device 300.

Advantageously, the provided remote device allows for increased surface area with which additional selection buttons can be coupled. In addition, the additional surface area allows for fewer selection buttons to be coupled on each side surface. The fewer selection buttons per side surface assists in reducing the cognitive complexity of the remote by reducing the number of buttons for a user to select from a single surface. Using the multiple sides of the device for different devices allow for the elimination of duplicate remote controls. The main body and cover member can be rounded or cylindrically shaped, which is comfortable for a user's hand. A further advantage provided is that since the cover member rotates about the main body, the cover member is not placed in a position where it could easily be broken off. The door protects the selection buttons from being inadvertently actuated when the remote is set on a surface, such as a table or the floor. In addition, the door protects the selection buttons from being inadvertently actuated when the remote device is grasped by a user. The locking feature prevents access to certain features and/or selection buttons of the remote device. Parents can better supervise what functions or television shows to which their children or others have access.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A system comprising a host device adapted for accomplishing a predefined function;

a wireless remote control device adapted for controlling operation of the host device; and the remote control further comprising a main body including at least a first surface and a second surface, the first surface having at least one selection button associated therewith, a cover member rotatably coupled with the main body, the cover member rotatable around the main body, where the cover member is capable of being positioned to expose only the first surface on the main body, and wherein at least two of the surfaces provide for remote control of different electronic equipment.

2. The system of claim 1, wherein the cover member of the remote control has an end surface that includes a child proof cap.

3. The system of claim 1, wherein the cover member of the remote control has an end surface that includes a key lock.

4. The system of claim 1, wherein the main body includes a third surface, and wherein the first, second, and third surfaces each include at least one selection button associated therewith.

5. The system of claim 1, wherein the main body includes a third surface, and wherein the cover member covers at least two of the surfaces of the main body in a first, second, or third position.

6. A device for remotely controlling electronic equipment, the device comprising:

a main body having at least a first surface and a second surface, one of said surfaces having at least one selection button associated therewith; and a cover member rotatably coupled with the main body, the cover member being rotatable around the main body, wherein the main body includes a third surface, and wherein the cover member covers at least two of the surfaces of the main body in a first, second, or third position, and wherein at least two of the surfaces provide for remote control of different electronic equipment.

7. The device for remotely controlling electronic equipment as recited in claim 6, the main body further comprising more than two side surfaces, where the cover member is adapted to cover each surface sequentially.

8. The device for remotely controlling electronic equipment as recited in claim 6, wherein the second surface further comprises at least one selection button associated therewith.

9. The device for remotely controlling electronic equipment as recited in claim 6, wherein the device further comprises a locking mechanism coupled with the cover member, whereby actuation of the locking mechanism restricts movement of the cover member.

10. The device for remotely controlling electronic equipment as recited in claim 9, wherein the locking mechanism comprises a combination of at least one projection and at least one detent.

11. The device for remotely controlling electronic equipment as recited in claim 6, wherein at least a portion of the main body has a cylindrical shape, the main body adapted to rotate within the cover member.

12. The device for remotely controlling electronic equipment as recited in claim 6, wherein the first surface is substantially parallel with the second surface.

13. The device for remotely controlling electronic equipment as recited in claim 6, wherein the cover member is removably coupled with the main body.

14. The device for remotely controlling electronic equipment as recited in claim 6, the device further comprising a spring mechanism disposed between the main body and the cover member such that the main body is frictionally coupled with the cover member.

15. The device for remotely controlling electronic equipment as recited in claim 6, wherein the cover member comprises a rounded shape.

16. The device of claim 2, wherein the main body includes a third surface, and wherein the first, second, and third surfaces each include at least one selection button associated therewith.

17. A device for remotely controlling electronic equipment, the device comprising:

a main body having a plurality of surfaces, including at least a first surface, a second surface, and a third surface, the first surface having at least one selection button associated therewith; and a cover member rotatably coupled with the main body, the cover member rotatable around the main body from a first position to a second position, where the cover member covers at least three surfaces in the first or second position, and wherein at least two of the surfaces provide for remote control of different electronic equipment.

18. The device for remotely controlling electronic equipment as recited in claim 17, the second surface further comprising at least one selection button associated therewith.

19. The device for remotely controlling electronic equipment as recited in claim 18, the third surface further comprising at least one selection button associated therewith.

20. The device for remotely controlling electronic equipment as recited in claim 17, the main body further comprising a fourth surface.

21. The device for remotely controlling electronic equipment as recited in claim 17, wherein the cover member covers at least two surfaces in the first or second position.

22. The device for remotely controlling electronic equipment as recited in claim 17, the main body further comprises a locking mechanism coupled therewith.

23. The device for remotely controlling electronic equipment as recited in claim 17, the cover member further comprises a locking mechanism coupled therewith.

24. A device for remotely controlling electronic equipment, the device comprising:

a main body having a plurality of surfaces, including at least a first surface, a second surface, and a third surface, the first surface having at least one selection button associated therewith, wherein at least two of the surfaces provide for wireless remote control of different electronic equipment; and a cover member removably coupled with the main body, the cover member rotatable around the main body from a first position to a second position, where the cover member covers the first surface in the first position and the cover member covers at least two of the surfaces of the main body in the first, the second, or a third position; and at least one attachment feature which couples the cover member with the main body.

25. The device for remotely controlling electronic equipment as recited in claim 24, wherein the cover member covers at least two surfaces in the first or second position.

26. The device for remotely controlling electronic equipment as recited in claim 24, wherein the attachment feature comprises a combination of a projection and groove.

27. The device for remotely controlling electronic equipment as recited in claim 24, wherein the attachment feature comprises a combination of a pin and an aperture.

28. The device for remotely controlling electronic equipment as recited in claim 24, wherein the cover member has an end surface that includes a child proof cap.

29. The device for remotely controlling electronic equipment as recited in claim 24, wherein the cover member has an end surface that includes a key lock.

30. The device of claim 24, wherein the first, second, and third surfaces each include at least one selection button associated therewith.

31. A device for remotely controlling electronic equipment, the device comprising:

a main body having a plurality of surfaces, one of these surfaces having at least one selection button associated therewith; and a cover member rotatably coupled with the main body, wherein the main body is capable of being rotated within the cover member, and wherein the cover member is capable of covering at least one of the surfaces of the main body while exposing another surface, and wherein at least two of the surfaces provide for remote control of different electronic equipment.

32. The device of claim 31, wherein the main body includes a first, a second, and a third surface, each having at least one selection button.

33. The device of claim 31, wherein the main body includes a first, a second, and a third surface, and wherein the cover member is capable of covering at least two of the surfaces of the main body while exposing another surface.

34. A device for remotely controlling electronic equipment, the device comprising:

a main body having at least a first surface, a second surface, and a third surface, each one of said surfaces having at least one selection button associated therewith for communicating with the electronic equipment in a wireless manner;

a cover member rotatably coupled with the main body, the cover member being rotatable around the main body, wherein the cover member allows access to each surface sequentially in a first, second, or third position, and wherein at least two of the surfaces provide for remote control of different electronic equipment;

a key lock provided at an end surface of the cover member to prevent rotation of the cover member when locked, allowing access to a single on of the surfaces.

* * * * *